US006612077B2

(12) United States Patent
Parshad

(10) Patent No.: US 6,612,077 B2
(45) Date of Patent: Sep. 2, 2003

(54) MOUNTING ARRANGEMENT FOR WHITEBOARD

(75) Inventor: David A. Parshad, Markham (CA)

(73) Assignee: Inscape Corporation, Holland Landing (CA)

( * ) Notice: Subject to any disclaimer, the term of this patent is extended or adjusted under 35 U.S.C. 154(b) by 0 days.

(21) Appl. No.: 09/881,067

(22) Filed: Jun. 15, 2001

(65) Prior Publication Data

US 2002/0189171 A1 Dec. 19, 2002

(51) Int. Cl.[7] ..... E04B 2/74

(52) U.S. Cl. ..... 52/36.5; 52/239; 52/220.7; 52/481.2; 52/489.1; 160/351

(58) Field of Search ..... 52/36.4, 36.5, 52/36.6, 220.7, 238.1, 239, 243, 481.2, 481.1; 160/351, 135; 174/48, 49

(56) References Cited

U.S. PATENT DOCUMENTS

| | | | | | |
|---|---|---|---|---|---|
| 4,642,418 | A | * | 2/1987 | Menchetti | 174/48 |
| 4,685,255 | A | | 8/1987 | Kelley | |
| 5,038,539 | A | | 8/1991 | Kelley | |
| 5,121,578 | A | * | 6/1992 | Holz | 52/506.01 |
| 5,241,796 | A | * | 9/1993 | Hellwig et al. | 52/239 |
| 5,400,560 | A | * | 3/1995 | Hellwig et al. | 52/476 |
| 5,406,760 | A | * | 4/1995 | Edwards | 160/351 |
| 5,511,348 | A | | 4/1996 | Cornell et al. | |
| 5,675,946 | A | | 10/1997 | Verbeek et al. | |
| 5,675,949 | A | | 10/1997 | Forslund et al. | |
| 5,724,778 | A | | 3/1998 | Cornell | |
| 5,768,840 | A | | 6/1998 | Feldpausch et al. | |
| 5,852,904 | A | * | 12/1998 | Yu et al. | 160/135 |
| 5,906,079 | A | | 5/1999 | Brickner | |
| 5,913,787 | A | * | 6/1999 | Edwards | 174/48 |
| 5,966,879 | A | | 10/1999 | Verbeek | |
| 6,003,275 | A | | 12/1999 | Cornell | |
| 6,076,317 | A | * | 6/2000 | Hellwig et al. | 52/220.7 |
| 6,088,981 | A | * | 7/2000 | Edwards | 52/220.7 |
| 6,250,020 | B1 | * | 6/2001 | Shipman | 52/238.1 |
| 6,446,396 | B1 | * | 9/2002 | Marangoni et al. | 52/220.7 |

FOREIGN PATENT DOCUMENTS

| | | | | |
|---|---|---|---|---|
| JP | 64-44896 | * | 2/1989 | 52/220.7 |

* cited by examiner

*Primary Examiner*—Lanna Mai
*Assistant Examiner*—Winnie Yip
(74) *Attorney, Agent, or Firm*—Riches, McKenzie & Herbert LLP

(57) ABSTRACT

A display board which comprises a thin panel member adapted to be supported on an office wall partition to closely overlie a cover of a partition. The display board is preferably coupled to an internal frame of the partition by a mounting bracket which extends laterally inwardly over the top of a cover into engagement with the internal frame. With an inner surface of the display board lying on an outerface of the cover coupling to the framework to merely provide for support against vertical downward movement of the display board can be sufficient. Mounting separate brackets which extend from the framework outwardly above a cover are advantageously provided for ease of connection.

19 Claims, 11 Drawing Sheets

1
10
2'
2
1
3b
3a
3
3b
2'
2
3

MOUNTING ARRANGEMENT FOR WHITEBOARD

SCOPE OF THE INVENTION

The present invention relates to a mounting arrangement for a display board and, in particular, to a mounting arrangement for mounting whiteboards and the like on upright partitions of a modular office furniture system.

BACKGROUND OF THE INVENTION

Many display boards such as whiteboards, blackboards, chalk boards, tack boards, cork boards, magnetic boards and the like are known as having a planar display panel upon which information, writing and the like may be displayed as by, for example, writing with coloured erasable ink on whiteboards, writing with erasable chalk on blackboards and chalk boards, pinning materials and messages on tack boards and cork boards and securing magnetic letters and magnets to hold notices on magnetic boards. When such display boards are placed in an office, they are known to be fixed to a wall or other structure with a disadvantage that they are often difficult to attach and cannot be readily detached and moved to other locations. Other display boards are known which are provided with their own independent supports as, for example, on easels, or self-supporting frames so that the display boards can be moved within the office. The disadvantage of these types of display devices is that they may not be stable and can continue to occupy significant office space when not in use or when they are to be stored.

Modular office furniture systems utilizing modular partitions are known including such systems which utilize a panel assembly consisting of rectangular frames including vertical and horizontal frame members with cladding panels mounting to the framework. Known systems include interchangeable cladding panels in which one cladding panel has an outer surface which functions as a whiteboard. Such whiteboard cladding panels have the disadvantage that they are relatively expensive since they are coupled to the framework in the same manner as other covers. As well, such known whiteboard cladding panels require the replacement of an entire cladding panel in a modular manner and typically are not adopted for off modular use or for ease of installation, use or storage.

SUMMARY OF THE INVENTION

To at least partially overcome these disadvantages of previously known devices, the present invention provides a mounting arrangement for a display board, preferably a whiteboard, which can be easily mounted on an upright partition of a modular office furniture system.

It is an object of the present invention to provide a mounting arrangement for a display board which can facilitate the mounting of the display board in an upright position on a modular office furniture system.

It is another object of the present invention to provide a mounting arrangement which allows a display board to be mounted over any cladding panel of an upright partition as desired by a user.

Another object of the present invention is to provide an inexpensive display board assembly which can form an integrated part of a modular partition.

Accordingly, in one aspect, the present invention provides a mounting arrangement for a display board comprising:

an upright partition having a supporting framework formed of horizontal beams and vertical posts with the beams spaced vertically from each other, a plurality of cladding panels mounted to the framework to cover the same, each cladding panel having an outer surface spanning between a top and a bottom thereof, each cladding panel disposed outwardly of the horizontal beams with the top of each cladding panel proximate one horizontal beam and access to said one horizontal beam being provided via an opening adjacent the top of the cladding panel along the length of the cladding panel;

a display board member comprising a thin planar display panel having an outer surface and an inner surface, the outer surface adapted for overlying at least one cladding panel with the inner surface of the display panel in opposed relation to the outer surface of the cladding panel, the board member having at a top edge of the display panel a flange extending inwardly over the top of the at least one cladding panel through the opening and being coupled to the beam proximate the top of the adjacent cladding panel to support the board member therefrom.

The present invention provides a display board which comprises a thin panel member adapted to be supported on an office wall partition to closely overlie a cover of a partition.

The display board is preferably coupled to an internal frame of the partition by a mounting bracket which extends laterally inwardly over the top of a cover into engagement with the internal frame. With an inner surface of the display board lying on an outerface of the cover coupling to the framework to merely provide for support against vertical downward movement of the display board can be sufficient. Separate mounting brackets which extend from the framework outwardly above a cover are advantageously provided for ease of connection. Preferably, a tray member may be provided below the display board as to hold items such as pens, eraser brushes and the like. The tray member may be integral with the display board or preferably independently mounted therebelow as by a mounting bracket extending laterally inwardly under the bottom of a cover into engagement with the internal frame.

BRIEF DESCRIPTION OF THE DRAWINGS

Further aspects and advantages of the present invention will become apparent from the following description taken together with accompanying drawings in which.

DETAILED DESCRIPTION OF THE DRAWINGS

Figure 1:
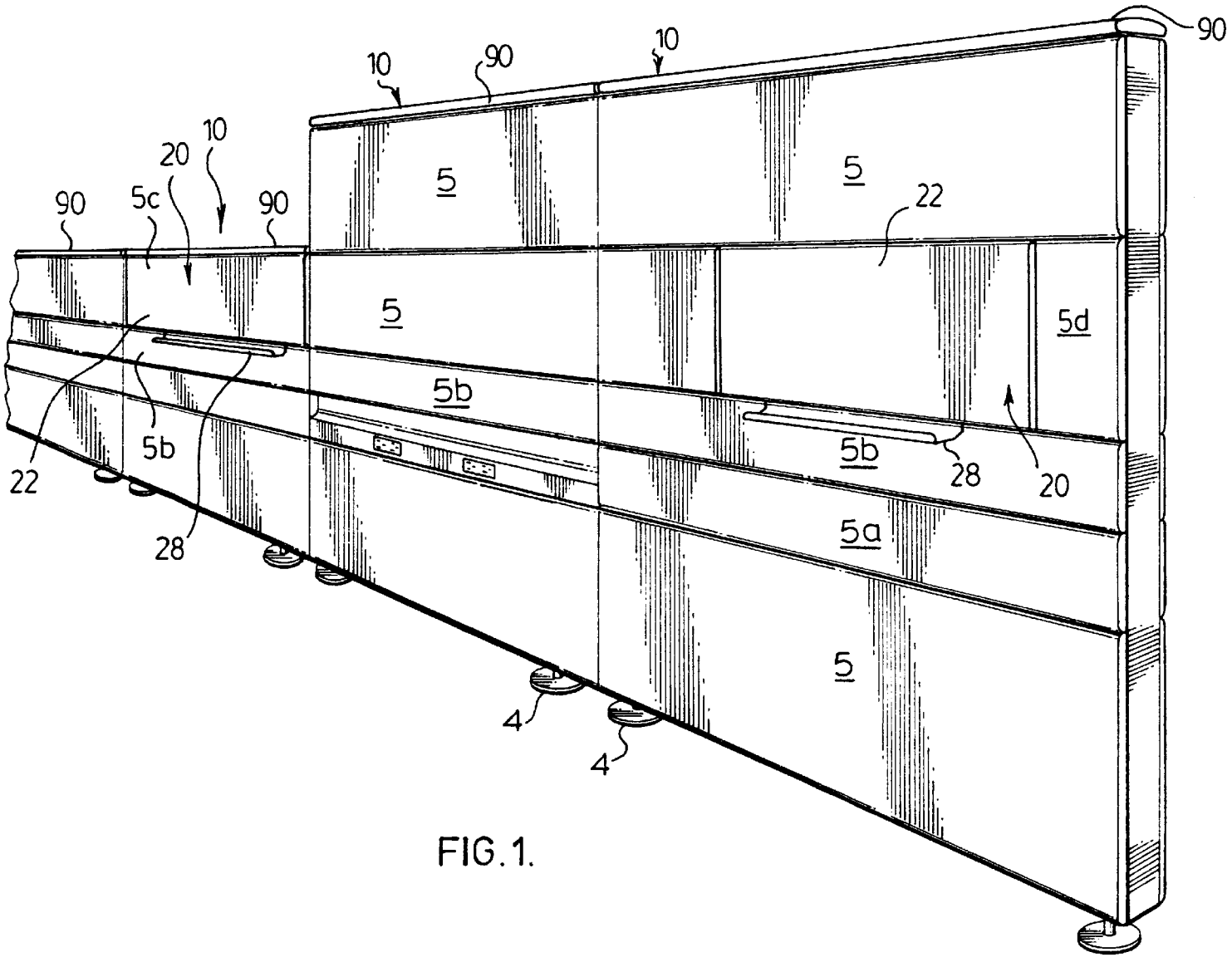
FIG. 1 shows a front perspective elevation view of an assembled modular office furniture partition wall including a number of partitions to which two display board assemblies are mounted in accordance with the present invention.

Reference is made first to FIG. 1 which shows an assembled modular office furniture partition wall on which there are mounted two display board assemblies 20 in accordance with the present invention.

Figure 3:
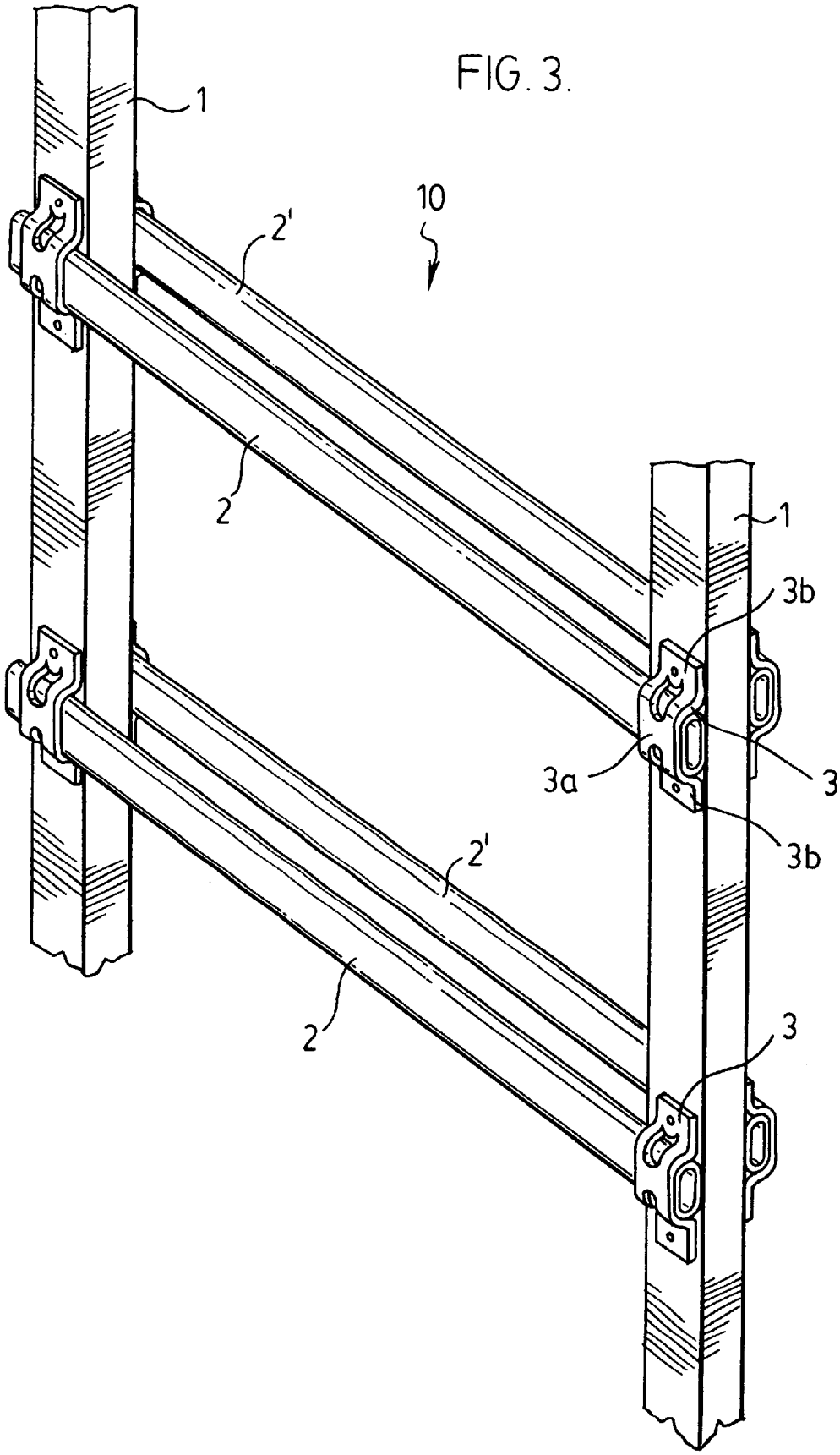
FIG. 3 is an enlarged view showing schematically a section of a rectangular frame of a partition having the same construction as shown in FIGS. 1 and 2.

The partition wall includes a number of partitions of the type disclosed in U.S. Pat. No. 6,088,981 to Edwards issued Jul. 18, 2000, the disclosure of which is incorporated herein by reference. The partition wall comprises a plurality of rectangular partitions 10 shown to be arranged end-to-end for convenience. Each partition 10 comprises a generally rectangular frame including vertical posts 1 and horizontal beams 2 and 2'. As best illustrated in FIG. 3 which shows a schematic partial view of the frame of one partition 10, the beams 2, 2' are preferably arranged in parallel pairs outwardly on both sides of each post 1 with the beams on each side vertically above each other and vertically spaced from each other. The beams 2 and 2' are connected to the outward opposing front and rear surfaces of each post 1. Both the posts 1 and the beams 2, 2' are preferably tubular in cross-section as shown. The posts 1 and beams 2, 2' are connected with brackets 3 having a saddle portion 3*a* of internal profile mating with the external profile of the beams 2, 2'. The brackets 3 include flange portions 3*b* above and below the saddle portions 3*a* which overlie and are connected to the outward face of the associated post 1 as by screws, rivets, welding and the like.

Figure 2:
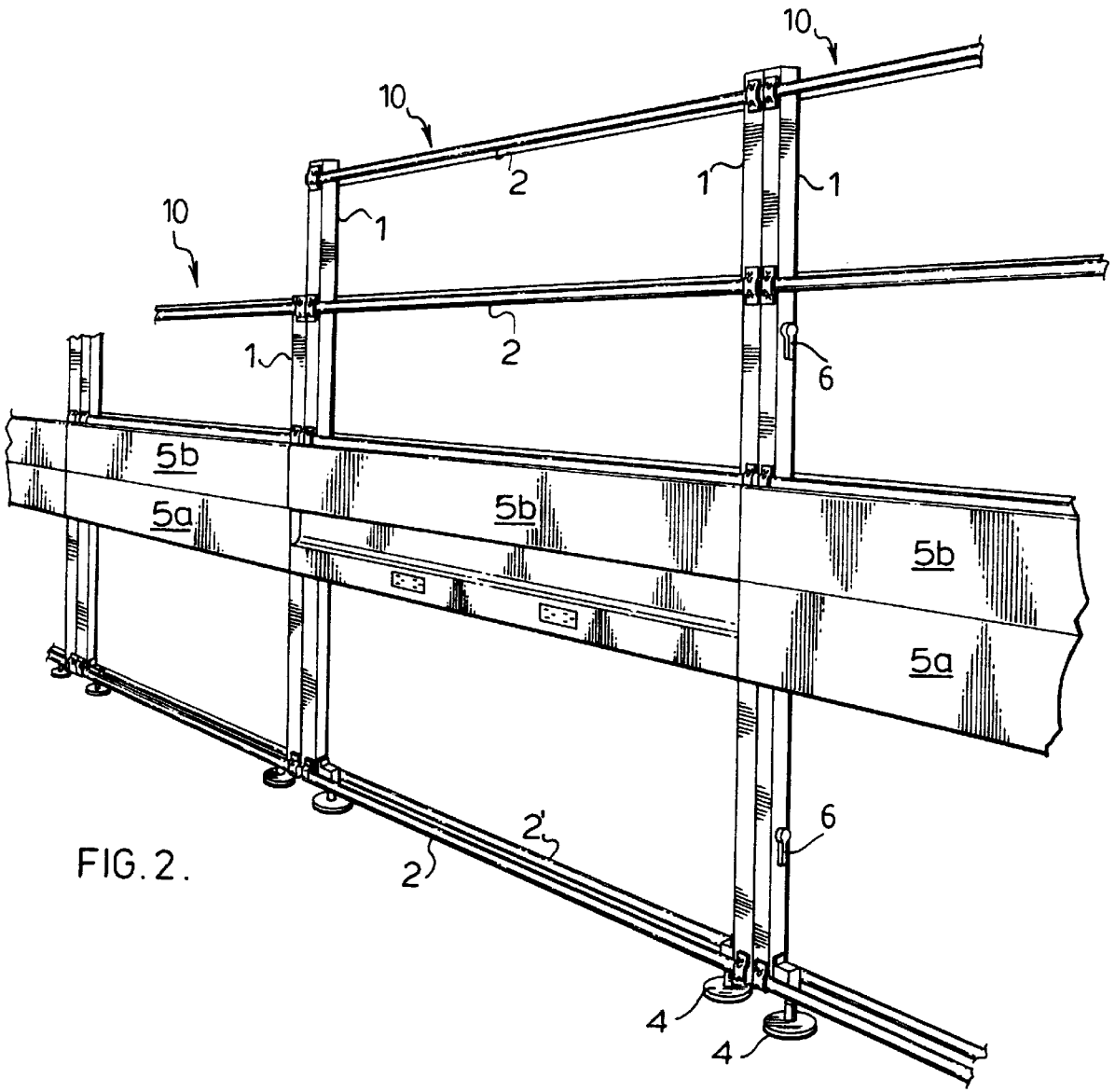
FIG. 2 is a frontal perspective view of the partition wall of FIG. 1 with the display board assemblies and some of the cladding panels removed to reveal the internal frame.

As seen in FIG. 2, each of the posts 1 has an adjustable height foot 4 at the base thereof to support the partition and level the partition on a floor surface. The posts 1 of adjacent partition assemblies are shown connected as in FIG. 2 in line with posts 1 of adjacent partitions as by connectors generally indicated as 6.

Figure 6:
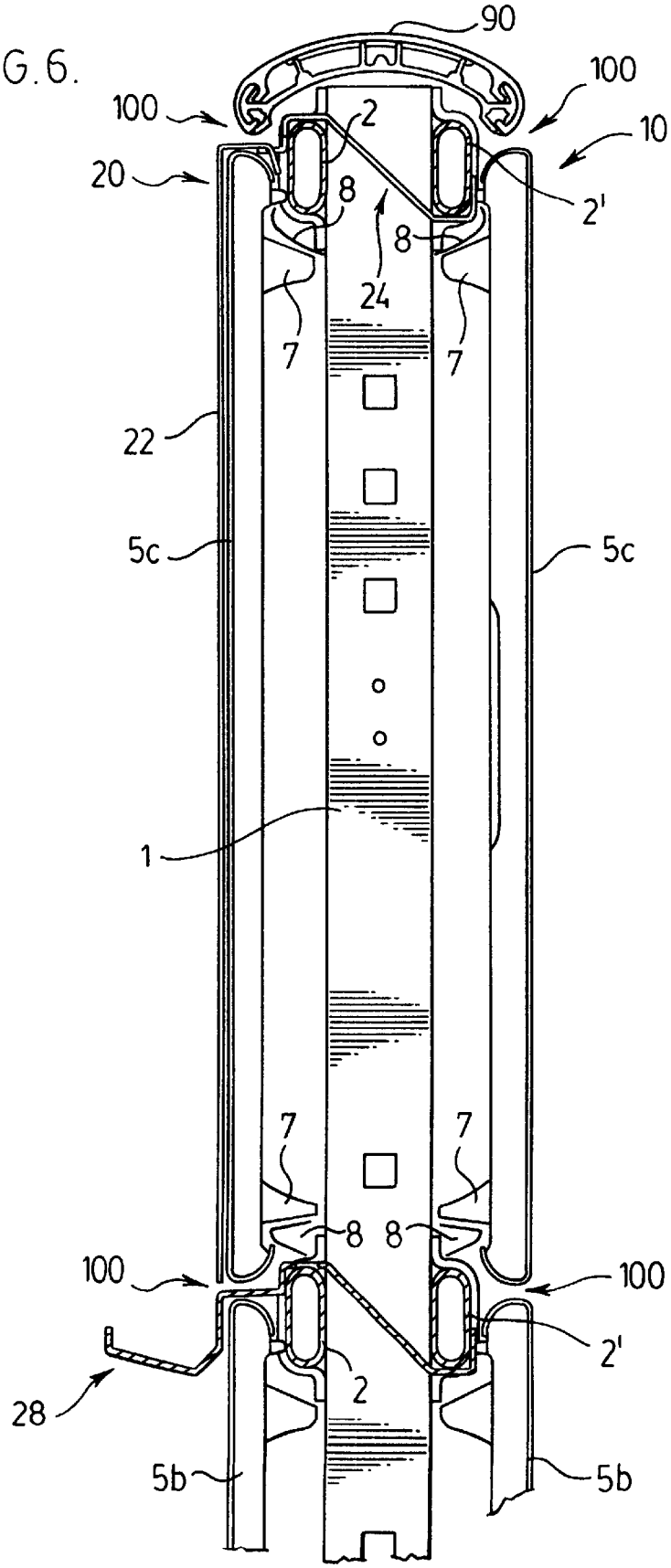
FIG. 6 is a cross-sectional view along section line vi–vi' of FIG. 5 showing the display board assembly in accordance with the first embodiment of FIG. 4.

Cladding panels or covers generally indicated as 5 but also specifically indicated as 5*a*, 5*b*, 5*c* and 5*d*, are coupled to the frame as may be seen, for example, in FIGS. 2 and 6, laterally outwardly of the beams 2, 2'. Coupling mechanisms are provided for removably mounting the covers 5 to the frame, however, such mounting mechanisms are only schematically illustrated for the purpose of simplicity in FIG. 6 as clips 7 mounted to inward faces of the covers 5 near their tops and bottoms for releasable engagement with complementary resilient clips 8 carried on the beams 2, 2' or on the posts.

As shown, many of the covers and those particularly indicated as 5, 5*c* and 5*d* are full covers in the sense that they preferably span vertically between adjacent parallel vertically spaced beams 2 on the same side of the posts. In the middle portion of the partition, there are shown partial covers 5*a* and 5*b* which generally span about half the distance between two adjacent beams and may be, for example, coupled to each post intermediate the beams.

As seen in FIGS. 1 and 6, removable top caps 90 are provided to cover the top of each partition 10. As is known, the covers 5 and the top caps 90 or at least some of them are preferably readily removable to permit access to the interior of the partition.

A feature of the partition 10 is that an opening 100 exists above each cover 5, preferably substantially along the length of each cover, which permits access from in front of a cover inwardly past the cover to the framework and, particularly, to beam 2, 2' which is disposed along the top of any one of the covers 5. This opening 100 is provided above the top of each cover 5 whether, as seen in FIG. 6, between an uppermost cover 5*c* and the top cap 90 thereabove or between an intermediate cover 5*b* and the cover 5*c* thereabove. It also follows that this opening 100 is provided at the bottom of each cover 5.

Figure 4:
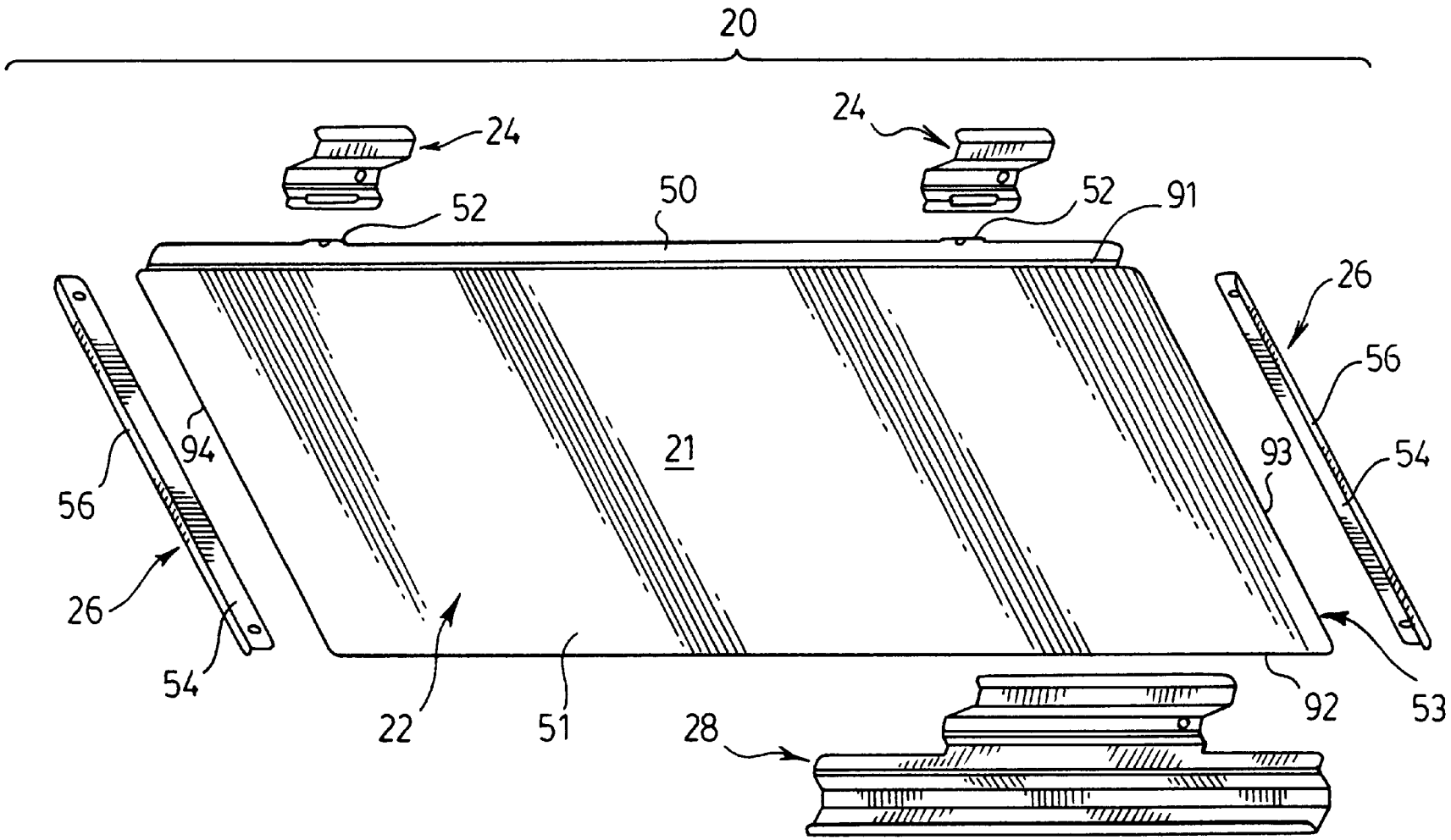
FIG. 4 is an exploded view of a display board assembly in accordance with a first preferred embodiment of the present invention.

Reference is now made to FIG. 4 which shows an exploded view of a display board assembly 20 in accordance with a first preferred embodiment of the present invention. The display board assembly 20 comprises a display board member 22, two mounting brackets 24, two side flange members 26 and a tray member 28. The board member 22, the mounting brackets 24, the flange members 26 and the tray member 28 are preferably made of thin sheet material, preferably a thin sheet of metal as by a stamping operation. Preferably, the mounting brackets 24 are identical and interchangeable. Preferably, the flange members 24 are also identical and interchangeable.

Figure 7:
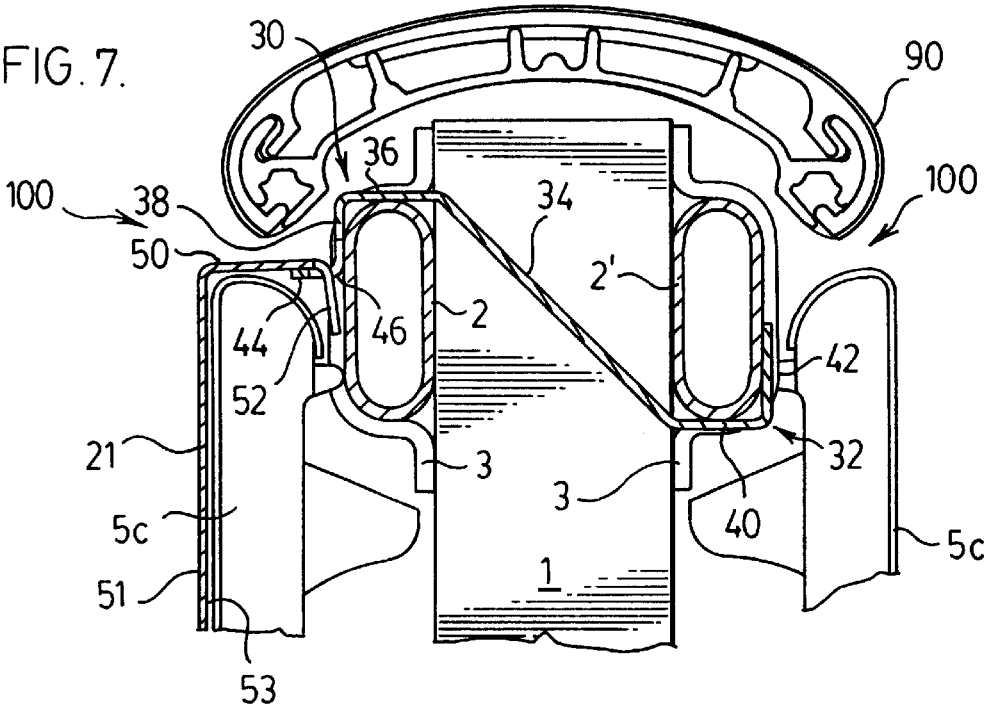
FIG. 7 is an enlarged view of the top end of FIG. 6.
Figure 9:
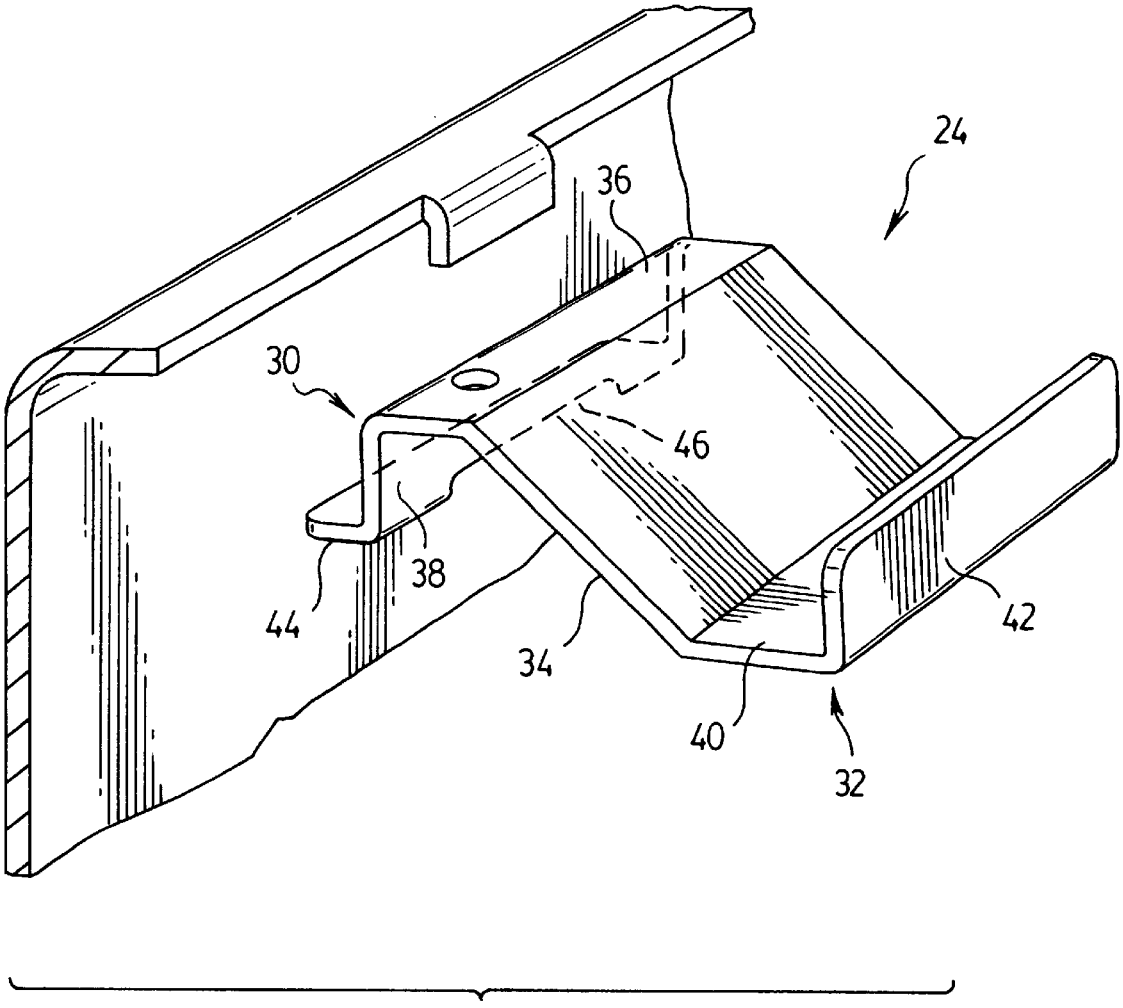
FIG. 9 is a schematic exploded perspective rear view showing coupling of a display board member to a mounting bracket in accordance with the first embodiment shown in FIG. 4.

The display board member 22 comprises a flat planar panel 21 with an elongate flange 50 provided substantially along the entire length of an upper edge of the panel 21. Two generally downwardly extending coupling tabs 52 are provided on the flange 50 as best seen in FIG. 9. As will be described later, the tabs are adapted to be inserted into respective slots 46 in the mounting brackets 24 as illustrated in FIG. 7. FIG. 7 shows the panel 21 has a front surface 51, a rear surface 53, an upper edge 91, bottom edge 92 and side edges 93 and 94. The front surface 51 of the panel 21 is adapted for displaying information thereon. In the preferred embodiment, the front surface 51 is provided with a suitable white coating to facilitate writing with erasable colour markers such that the display board comprises what is known in the industry as a "whiteboard".

Figure 5:
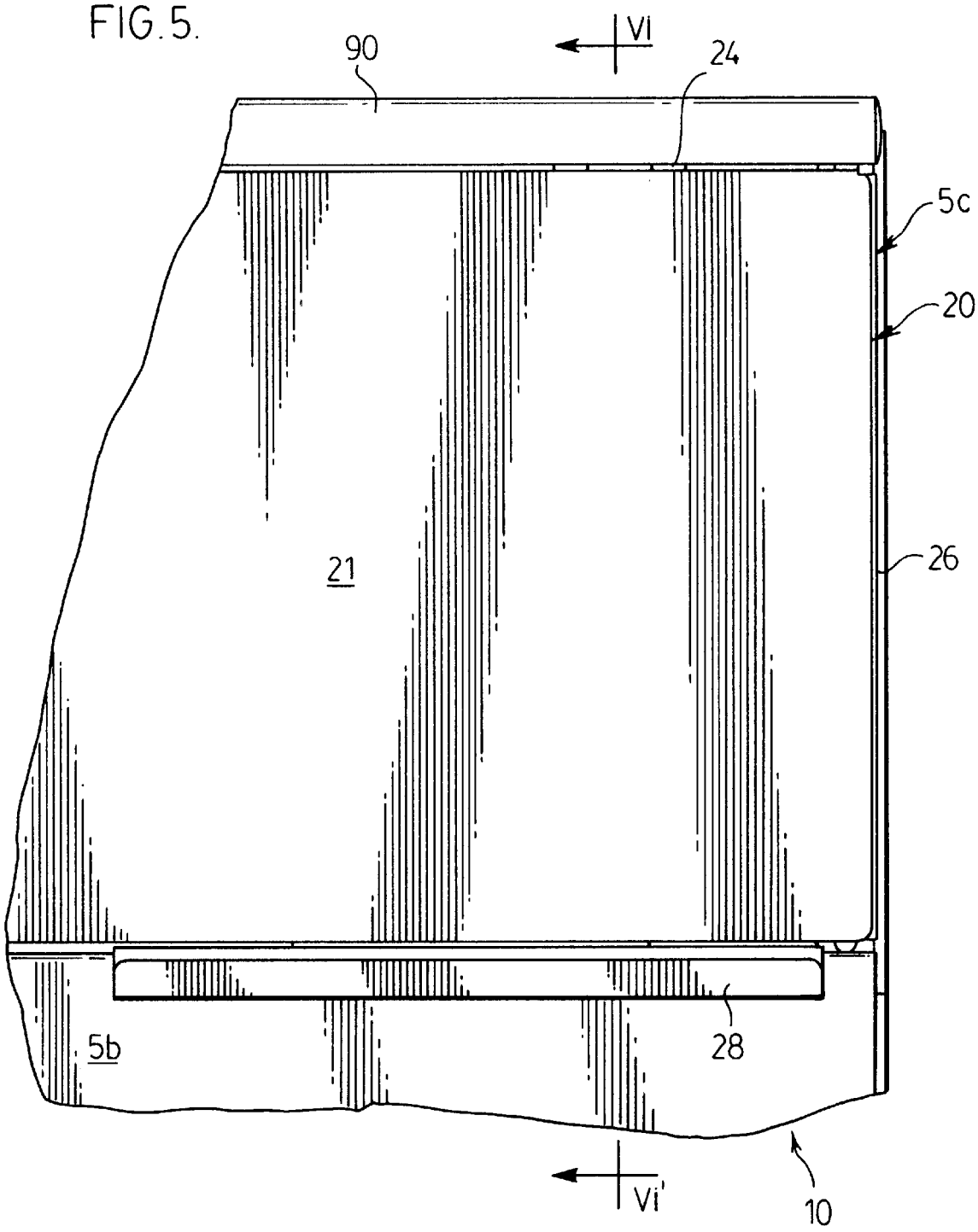
FIG. 5 is an enlarged fragmentary front elevational view of portions of FIG. 1 showing one display board assembly.
Figure 8:
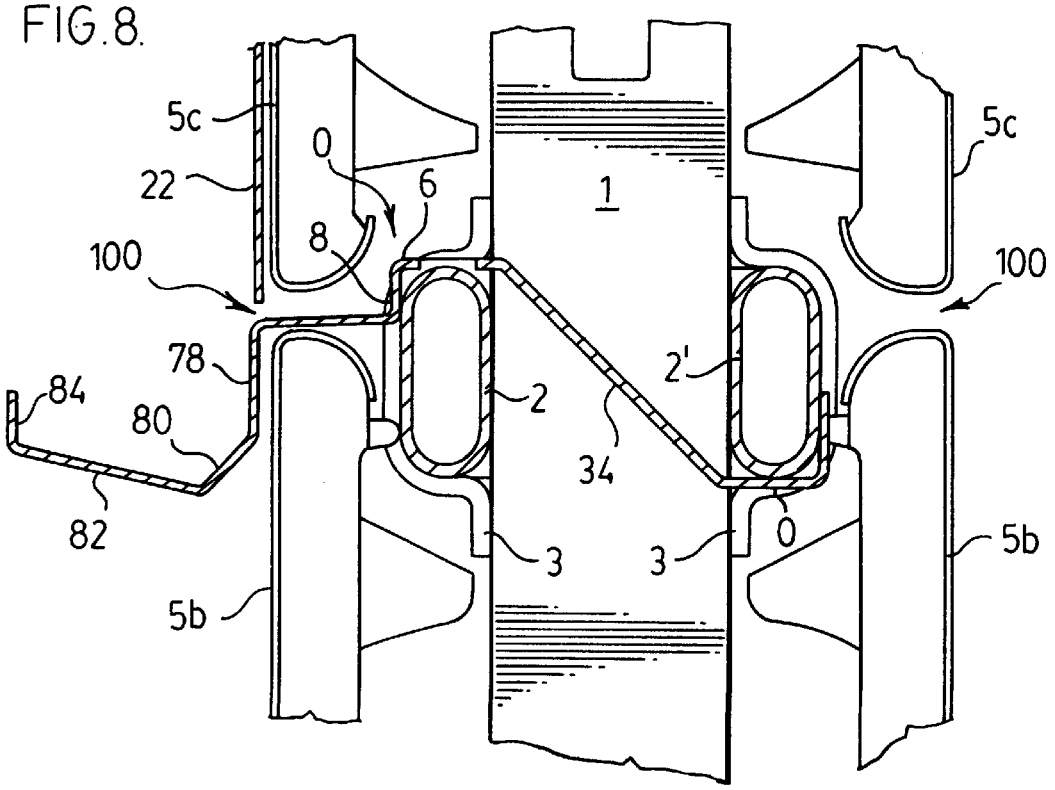
FIG. 8 is an enlarged view of the bottom end of FIG. 6.

As seen in FIG. 1, the display board assembly 20 is adapted to be mounted to the partitions 10 to at least partially overlie the covers 5. Reference is made to FIG. 5 which shows an enlarged front view of the display board assembly 20 overlying the cover indicated as 5*c*. FIG. 6 is a cross-sectional side view along section line v–vi' in FIG. 5. FIGS. 7 and 8 show enlarged side views of the top and bottom portions of FIG. 6.

As will be explained in greater detail, each of the mounting brackets 24 are coupled to the beams 2, 2' at the top of the cover 5*c*. The display board member 22 with the two-side flange members 26 attached along the side edges 93 and 94 of the panel 21 are supported over the cover 5*c* by the flange 50 of the board member 22 engaging the mounting brackets 24. Independently of the display board member 22 and its mounting brackets 24, the tray member 28 is mounted on two beams 2 and 2' disposed proximate the bottom of the cover 5*c*.

The two flange members 26 are elongate angle members having a first flange 54 and a second flange 56 disposed in planes at right angles to each other. The flange members 26 are secured along each vertical side edges 93 and 94 of the panel 21 with the first flange 54 in a plane parallel to that of the panel 21 and the second flange 56 extending normal to the plane of panel 21 and outwardly from the front surface 51 of the panel 21. The outwardly extending second flange 56 provides a physical barrier which assists in preventing the covers 5 from being contaminated by materials used on the display panel 21. For example, the second flanges 56 assist in preventing marker pens and/or brushes to erase markings from being brought into contact with adjacent covers 5. The flange members 26 may be secured by suitable methods including adhesion, welding, riveting, mechanical fasteners and the like.

Reference is made to FIGS. 7 and 8 which best show the mounting brackets 24 and the manner in which they are adapted to engage a pair of horizontal beams 2, 2' proximate the top of the cover 5*c*.

Each mounting bracket 24 is of a generally S-shape in cross-section as best seen in FIG. 7. A first L-shape section 30 is provided for engagement with an outer portion and an upper portion of the beam 2 on the left-hand side of the post 1. A second L-shaped section is provided for engagement with an outer portion and a lower portion of the beam 2' on the right-hand side of the post 1. An intermediate ramped bridging section 34 connects the first and second L-shaped sections 30 and 32. The first L-shaped section 30 is shown as having a horizontal top portion 36 to engage the top of the beam 2 and a downwardly extending side portion 38 to engage the outer side surface of the beam 2. A supporting ledge portion 44 extends outwardly to the left from the side wall portion 38.

The second L-shaped section 32 has a bottom portion 40 and a side portion 42 which extends upwardly therefrom. The bottom portion 40 is adapted to engage the bottom of the beam 2 and the side portion 42 is adapted to engage the outer side surface of the beam 2'.

The ledge portion 44 is disposed to extend outwardly generally horizontally. As best seen in FIG. 9, an elongate slot 46 is provided in the ledge portion 44 extending parallel to the ledge. This slot 46 is preferably provided at the junction of the wall portion 38 and the ledge portion 44. As best seen in FIG. 9, the slot 46 is adapted to receive the tab 52 of the flange 50 of the display board member 22.

For assembly, having regard to FIG. 7, the top cap 90 may be removed and each mounting bracket 24 may be manipulated to become coupled to the beams and adopt its configuration as shown in FIG. 7 with or without the cover 5*c* in place. Subsequently, with the cover 5*c* in place, the board member 22 is placed over the cover 5*c* with the rear surface 53 of the panel 21 to be located closely in front of the front surface of the cover 5*c*, with the flange 50 to overlie the ledge portion 44 and with the tab 52 on the flange 50 to extend downwardly into the slot 46. Preferably, as shown in FIG. 7, the flange 50 abuts on the ledge portion 44 lying substantially coplanar thereto and with the panel 21 substantially coplanar and engaging the front surface of the cover 5*c*. With the display 5*c* in place, the top cap 90 may be replaced.

Figure 10:
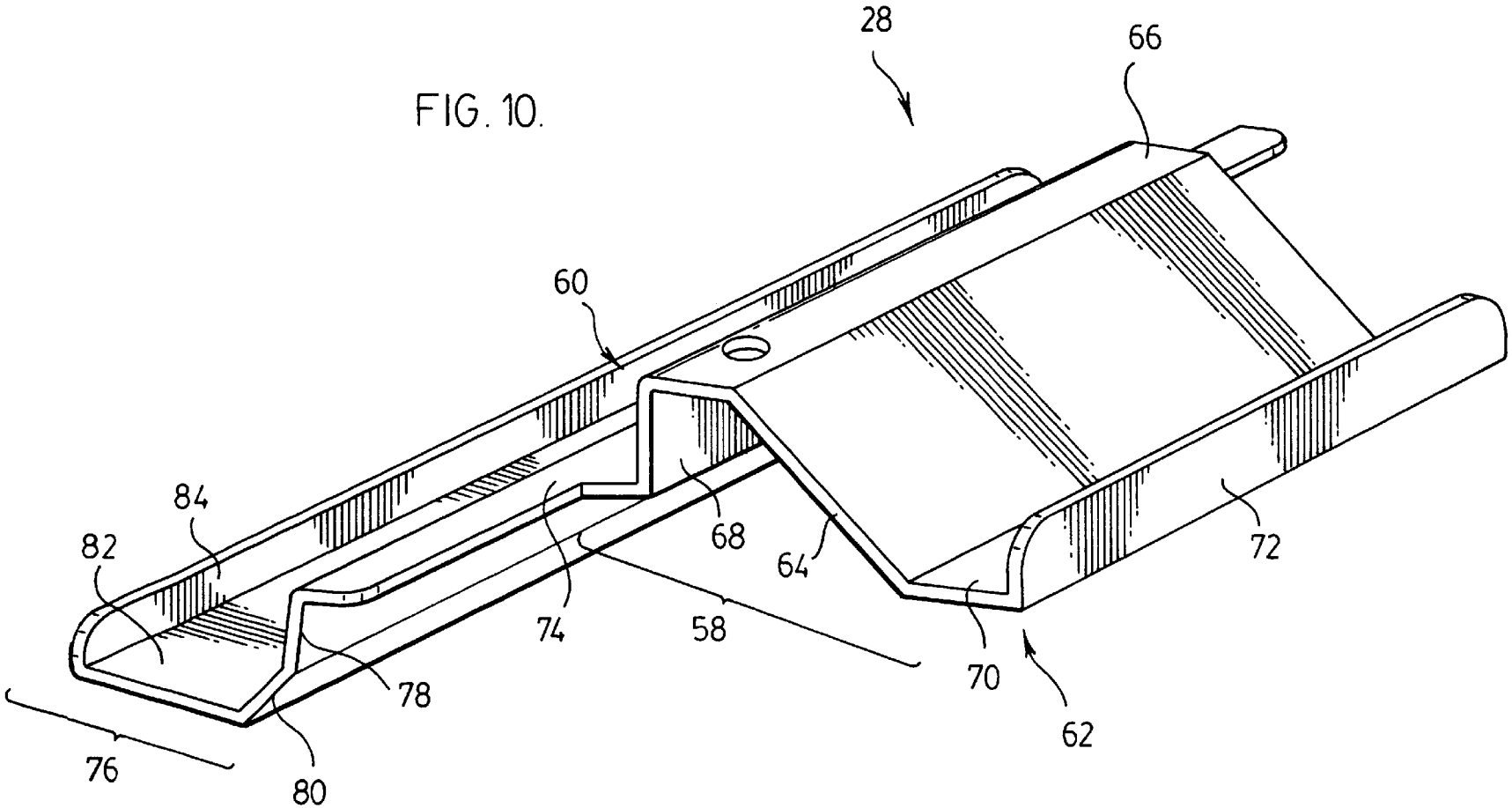
FIG. 10 is an enlarged perspective view of a tray member in accordance with the first embodiment of FIG. 4.

The tray member 28 is best shown in FIGS. 8 and 10. The tray member 28 includes a bracket section generally indicated 58 and a tray section generally indicated 76. The bracket section 58 has a cross-section substantially the same as that of each mounting bracket 24. Identical reference numbers are used to refer to equivalent elements of the bracket section 58 of the tray member and the mounting brackets 24. As seen, however, in FIGS. 8 and 10, in the tray member 28, the ledge portion 44 extends outwardly to the left generally horizontally below the cover 5*c* where it merges into the tray section 76. In this regard, the tray section 76 is formed by a downward extending wall portion 78, an outwardly and downwardly slanted floor portion 80, an outwardly and upwardly slanted floor portion 82 and an upwardly extending wall portion 84. Together the wall portion 78, floor portions 80 and 82 and the wall portion 84 form an elongated channel or tray for holding devices such as marker pens, brushes to erase markings, pencils, pens, magnets and the like as may be useful.

Regarding assembly, the tray member 28 shown in FIG. 8 is preferably applied prior to application of the display board member 22. To apply the tray member 28, preferably, the cover 5*c* thereabove is removed and the tray member 28 manipulated in place to become coupled to the beams 2 and 2'. With the ledge portion 44 extending from the beam 2 towards the left above the top of the cover 5*b*, the cover 5*c* may then be coupled to the beams 2 thereabove and the ledge 44 will extend outwardly via the opening 100 between the top of the panel 5*b* and the bottom of the panel 5*c*.

In the preferred embodiment, two bracket members 24 are shown and the display board member 22 is shown as carrying two complementary tabs 52. It is to be appreciated that merely one bracket member 26 can be sufficient. Preferably, more than one bracket member is provided, preferably two, however, three or more bracket members can be utilized. The bracket members 24 are adapted to engage the beams 2 and 2' in varying positions between the posts. This is advantageous to permit the display board members to be mounted at various locations over different of the covers 5. For example, as seen in FIG. 1, a display board assembly 20 is shown as mounted over cover 5*d*. The display board member 22 mounted over cover 5*d* is shown to be of a length which is less than the length of the cover 5*d*. This display panel may, therefore, as desired by a user, be mounted so as to be centered or moved to the left and right relative to cover 5*d*.

Referring to FIG. 1, the display board member 22 mounted over cover 5*c* is shown to be of the same length as the cover 5*c* and to substantially cover the panel 5*c*. This is not necessary. The panel 21 of any display board member 22 may have a length between side edges 93 and 94 which is equal to, less than or greater than the length of any cover to be covered. The panel 21 may also have a width between top and bottom edges 91 and 92 which is equal to, less than or greater than the vertical extent of any cover. In that the mounting brackets may engage the beams 2 at any locations, it is to be understood that, for example, the display board member 22 shown as mounted on top of cover 5*c* in FIG. 1 could be mounted so it partially overlies cover 5*c* and partially overlies a cover 5 adjacent to cover 5*c*. Thus, a first mounting bracket 24 could engage the beams of one partition 10 and a second mounting bracket 26 could engage the beams of a second partition 10.

FIGS. 6, 7 and 8 show a display board member 22 mounted over the cover 5*c* which is disposed immediately underneath the top cap 90 and with the flange 50 to extend through opening 100 between the top of the cover 5*c* and the top cap 90. It is to be appreciated that a display board member 22 in accordance with the present invention may be mounted over any of the covers 5 with the flange 50 to extend through the opening 100 between the vertically arranged covers as, for example, is the case with the display board member 22 mounted over cover 5*d* in FIG. 1. Such an opening 100 between the vertically arranged covers is illustrated, for example, in FIG. 8 as between the cover 5*c* and the cover 5*d*.

In accordance with the first embodiment, the bracket members 24 may preferably be sized so that they frictionally engage the beams 2 and 2'. In this regard, each of the generally downwardly extending side portion 38 and the upwardly extending side portion 42 of the bracket member 46 may extend inwardly towards their respective beam so as to frictionally clip onto the beams 2 and 2' although this is not necessary. It is also advantageous to have the mounting bracket 24 sized to be longitudinally slidable along the beams to assist in location of the mounting brackets 24 at desired locations.

It is to be appreciated that internal wiring, cabling and the like may be provided to extend in an interior space defined within the beams 2, 2' and the posts. In accordance with the present invention having the mounting brackets 24 to be of relatively small size permits the mounting brackets to be placed at different locations and/or for cabling within the partition to be moved.

If desired, the flange 50 of the board member 22 may be provided with a plurality of the tabs 52 so as to permit the mounting brackets 24 to be located at different longitudinal locations along the beams 2 yet be located under a selected one of the tabs 52.

The preferred embodiment shows, as best seen in FIG. 4, a display board assembly 20 including a number of components. Manufacturing the display board assembly 20 as a number of components is preferred but is not necessary in accordance with the present invention. Manufacture as a plurality of components has advantages from the point of view of manufacture and from the point of view of storage, installation and removal. In this regard, the front surface 51 of the panel 21 is preferably provided with a surface or covering which will function as a display surface. For example, in the context of being a whiteboard, a suitable white coating is to be applied thereto. As a matter of convenience for construction, it is advantageous to have the element comprising merely the panel 21 and its flange 50 as a separate element which can readily have the suitable white coating applied thereto.

The side flange members 26 are not necessary but are preferred. Providing each as a separate element can be advantageous so that the side flange members 26 may have a different coating or painting than the panel 21. It is to be appreciated that rather than provide the side flange members 26 as separate elements, they could readily form an integral part of the panel 21 by being flanges bent to extend outwardly therefrom.

To simplify manufacture, it is preferred that the mounting brackets 24 be separate elements from the board member 22. This is not necessary, however, and bracket members having a configuration identical to that shown in FIG. 4 could be provided as an integral extension of the flange 50 as by permanently securing the flange 50 to the ledge portion 44 as by rivets or the like and eliminating the tabs 52. Even with the bracket members 24 permanently attached to the panel 21, the resultant panel could still relatively readily be manipulated to suitably insert the bracket members 24 for engagement with the beams while a top cap 90 or cover 5 thereabove has been removed.

Figure 11:
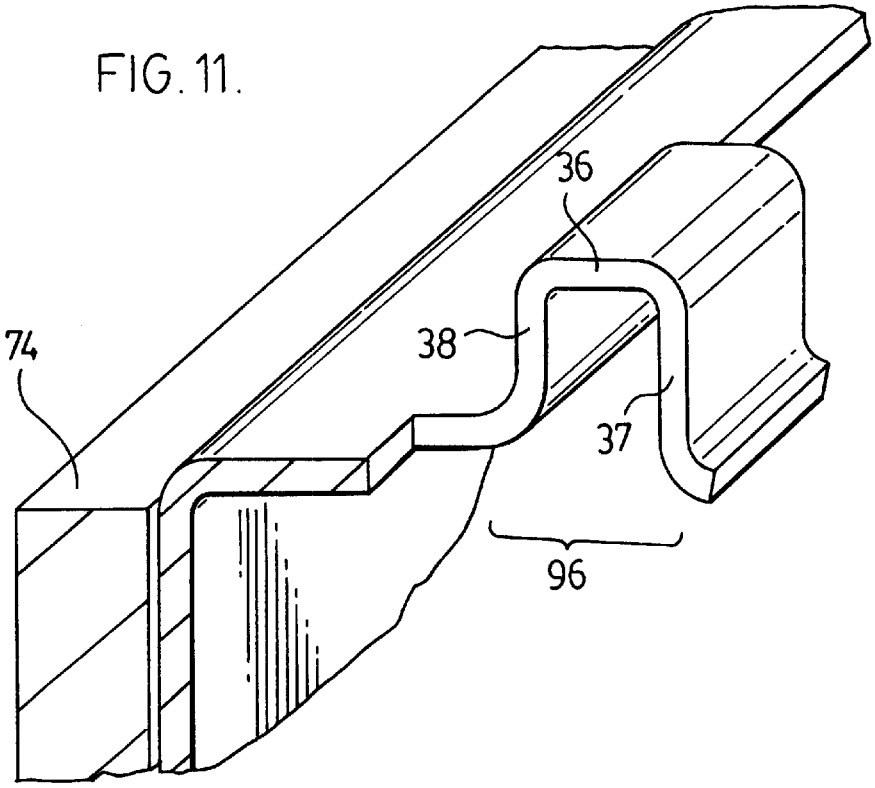
FIG. 11 is a rear perspective view similar to that of FIG. 9, however, of an upper portion of a display board member in accordance with a second embodiment of the present invention.

Reference is made to FIG. 11 which shows a second embodiment of the board member 22 which carries a mounting bracket section 96 as an integral part thereof. The mounting bracket section 96 shown is adapted to engage merely one beam, beam 2, on one side of the post. The mounting bracket section 96 includes not only an outward wall portion 38 and a top portion 36 but also a downwardly extending inner wall portion 37 to engage an inwardly directed surface of the beam 2. As is to be appreciated, a series of such mounting bracket sections 96 could be provided along the length of the board member 22.

Figure 12:
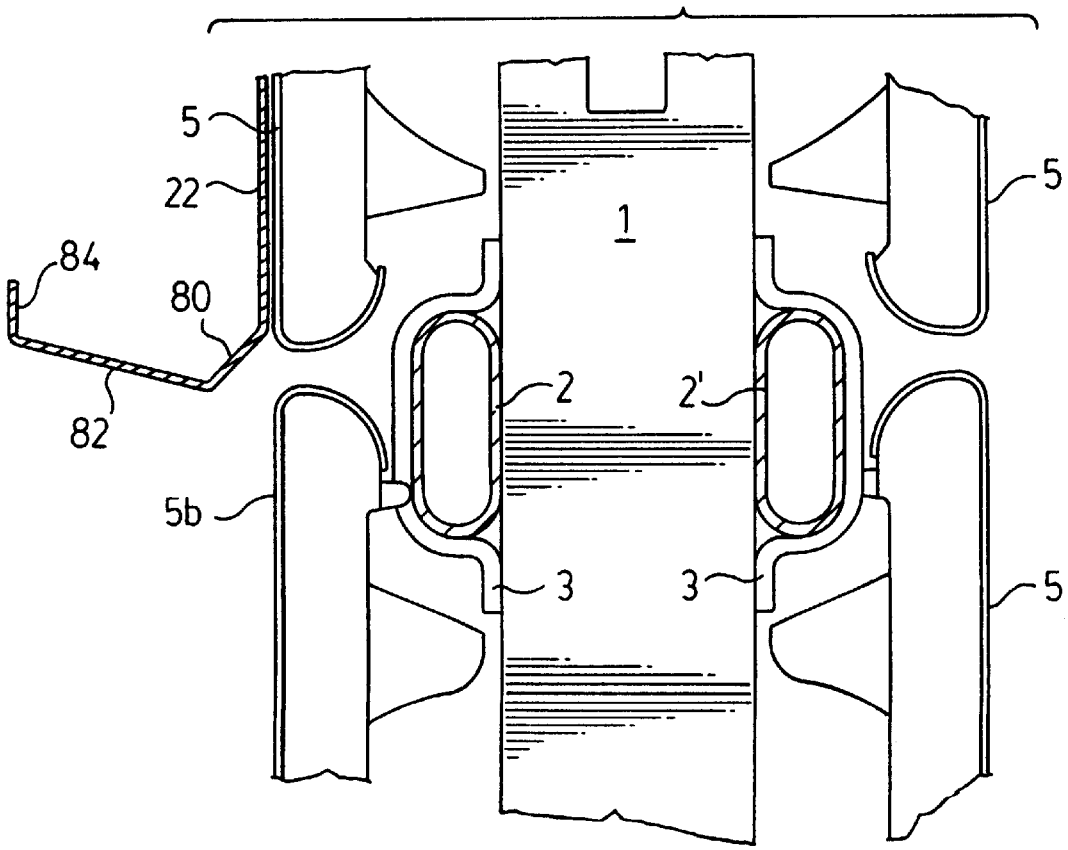
FIG. 12 is a schematic cross-sectional side view similar to FIG. 8, however, of a display board member in accordance with a third embodiment of the present invention.

Reference is made to FIG. 12 which shows a cross-sectional side view similar to that of FIG. 8, however, in which a tray section 97 is provided as an integral part of the board member 22 as an extension of the bottom edge 92 of the panel 21 as floor portions 80 and 82 and wall portion 84 depending therefrom. A whiteboard which incorporated the features of both FIGS. 11 and 12 could be formed from a unitary piece of sheet material, preferably metal.

In the first preferred embodiment illustrated, for example, in FIG. 6, panel 21 extends vertically a height such that the bottom edge of the panel 21 is at the same height as the bottom edge of a cover 5*c*. However, in FIG. 6, the tray section 76 is shown as located at a height below panel 5*c* and extending to overlap cover 5*b* below cover 5*c*. It is to be appreciated that the vertical width of the panel 21 can be selected so that it may extend vertically over one or more covers or may be of a height less than any one cover.

The third embodiment of the invention illustrated in FIG. 12 illustrates an arrangement in which the tray section is disposed at a height above the top of cover 5*b* therebelow as can be of assistance in permitting easy removal of the cover 5*b* without the need to first remove the interference from a tray member.

Figure 13:
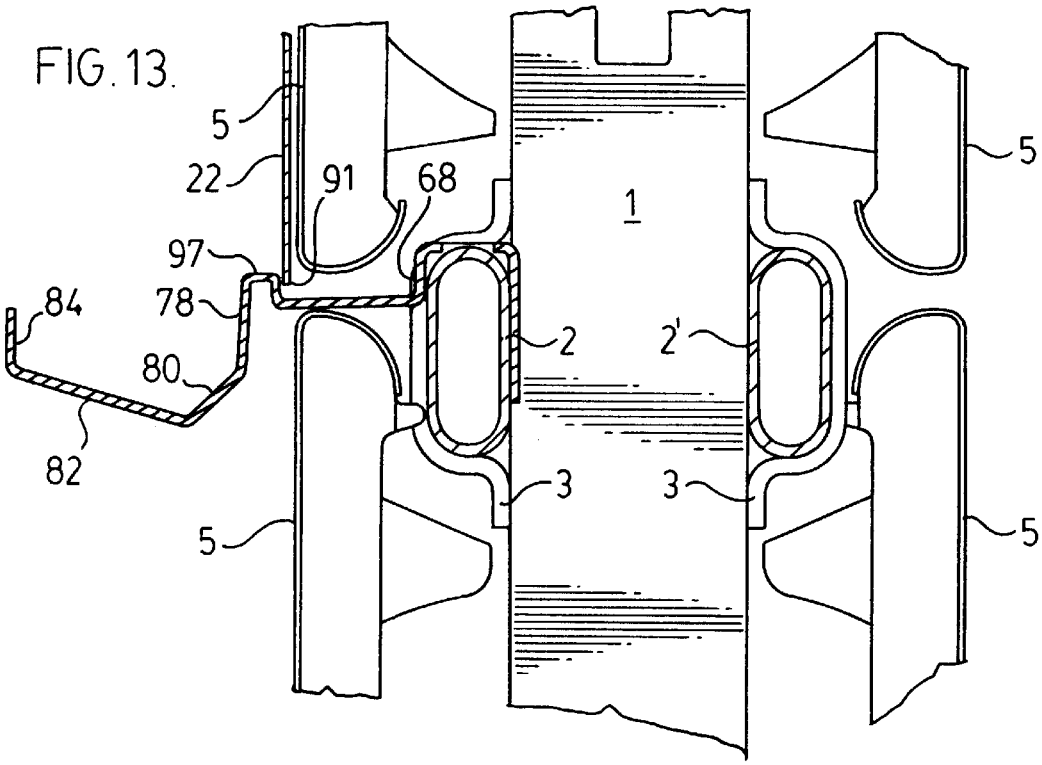
FIG. 13 is a schematic side view similar to FIG. 8, however, of a tray member in accordance with a fourth embodiment of the invention.

It can be advantageous to have a tray member 28 which is separate from the display board member 22 yet coupled to the display board member 22. In this regard, reference is made to FIG. 13 which shows as a fourth embodiment a configuration identical to that shown in FIG. 8, however, with the tray member 28 includes an upwardly extending catch portion 97 which is adapted to extend upwardly above the lower edge 91 of the panel 21 so as to engage the lower edge 91 of the panel 21 and assist in holding the panel 21 against movement of its lower edge outwardly away from the cover 5*c*. The catch portion 97 may preferably bias the lower end of the panel 21 inwardly into the cover 5*c*.

Figure 14:
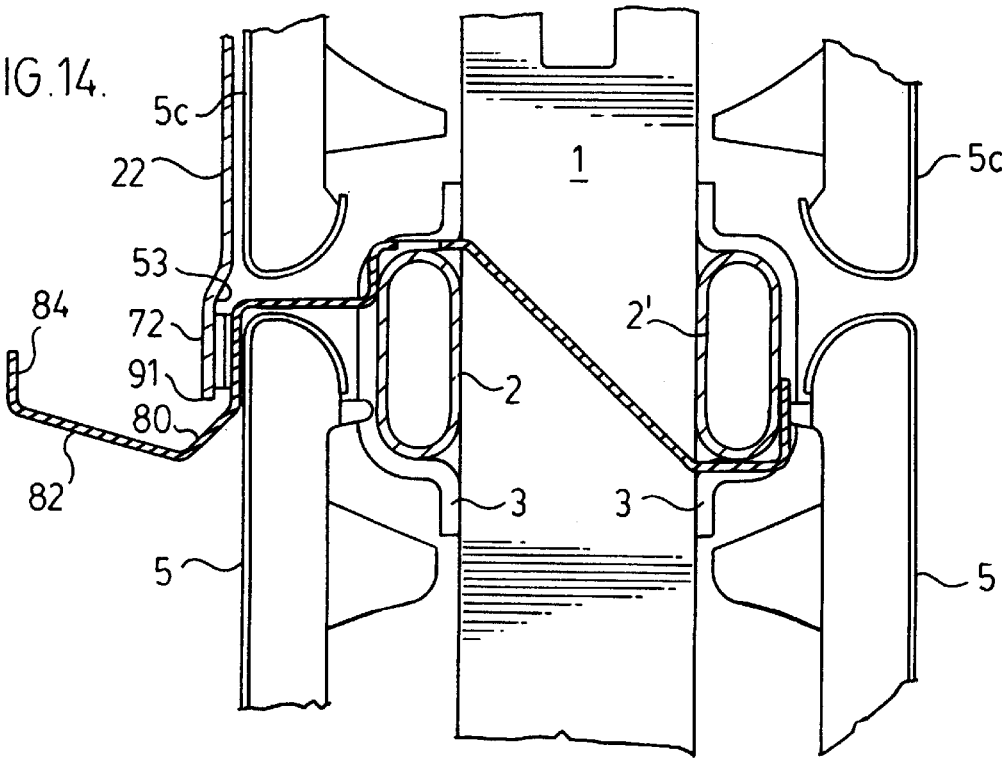
FIG. 14 is a schematic side view similar to FIG. 8, however, of a display board member in accordance with a fifth embodiment of the present invention.

Reference is made to FIG. 14 which shows a further embodiment. FIG. 14 is identical to that shown in FIG. 8 with the exception that the panel 21 is provided with an extension portion 72 along its lower edge 91 which extends downwardly to vertically overlap with the wall portion 78 of the tray member 22 outwardly thereof. An outwardly disposed outer surface of the wall portion 78 and an inner surface 53 of the panel 21 overlap and may be provided with complementary touch fastening mechanisms such as VELCRO brand hook and eye fasteners.

The display board member 22 in accordance with the present invention may have a panel 21 which is adapted for various display and indication purposes. The panel 21 may preferably comprise a whiteboard as is known for marking with erasable markers. In accordance with the first preferred embodiment, the panel 21 is a thin sheet of metal with a white coating layer on its outer surface 51 to form a whiteboard. The panel 21 may also comprise a blackboard or a chalk board which would provide a surface which could be marked by chalk. Blackboard and chalk board surfaces are known which can be applied as a coating to a planar substrate such as a metal sheet.

The panel 21 can be a metal sheet to which magnets can be magnetically attached with such magnets being themselves letters or indicia which display information. Alternatively, magnets could be used to secure paper notices and the like to the display surface.

Reference is made to FIG. 11 which shows a layer 74 of material secured to panel 21 to overlie the panel. The layer 74 may comprise a material forming a whiteboard, a blackboard, chalk board or the like. The layer of material 74 could also comprise a layer of cork or other soft material so as to provide what is conventionally known as tack board or a cork board being a display board which permits securing of paper and other articles thereto as by sticking tacks, pins and the like into the soft surface layer. The panel 21 could carry various other surfaces and substrates which are preferably substantially planar and provide for marking and/or display.

The display board assemblies in accordance with the present invention have been particularly described for use with partitions of the type shown in U.S. Pat. No. 6,088,981. The invention is not so limited and the invention may be utilized with any partitions having members which can structurally support the display board assemblies and are accessible through openings above covers. Such support members may include horizontal beams, troughs, channels and the like of an internal frame.

The first embodiment as illustrated in FIG. 9 shows the flange 50 on the panel 21 to overlie the ledge portion 44 and to be coupled thereto by tab 52 extending into slot 46. Various other arrangements may be provided to couple the flange 50 to the ledge portion 44. For example, tabs could be provided on the ledge 44 to extend upwardly into a slot in the flange 50. The flange 50 and ledge portion 44 could be made to carry complementary hook and loop touch fasteners such as sold under the trade mark VELCRO. Preferably, the coupling of the flange 50 to the ledge portion 44 sets the distance the panel 21 is forward of the cover 5. In FIG. 9, the relative location of the tabs and slots can be established so that the panel 21 abuts the front surface of the cover.

In the preferred embodiment, the panel 21 is merely a thin sheet of material preferably no more than one inch thick, more preferably less than ¼ inch and, more preferably, less than 1/32 inch thick.

The preferred mounting brackets 26 as shown in FIG. 7 do not extend forwardly of the covers and may be left in place after a display board member 22 may be removed. Alternatively, the mounting brackets may extend further forwardly above the cover for coupling with the panel 21 whether or not an equivalent of a separate flange 50 may be provided.

The invention has been described with reference to preferred embodiments. Many modifications and variations will now occur to persons skilled in the art. For a definition of the invention, reference is made to the appended claims.

What is claimed is:

1. A mounting arrangement for a display board comprising:

an upright wall forming partition for dividing a workspace having a supporting framework extending upwardly from a floor surface formed of horizontal beams and vertical posts with the beams spaced vertically from each other, an interior space defined between the beams and posts for passage of utilities, a plurality of cladding panels removably mounted to the framework to cover the framework, the cladding panels removable to provide access to the interior space, each cladding panel having an outer surface spanning between a top and a bottom thereof, each cladding panel disposed outwardly of the horizontal beams with the top of each cladding panel proximate one horizontal beam and access to said one horizontal beam being provided via an opening adjacent the top of the cladding panel along the length of the cladding panel;

a display board member comprising a thin planar display panel having an outer surface and an inner surface, the display panel removably overlying at least one cladding panel with the inner surface of the display panel in opposed relation to the outer surface of the cladding panel, the display board member having at a top edge of the display panel a flange extending inwardly over the top of the at least one cladding panel through the opening and being removably coupled to the beam proximate the top of the at least one cladding panel by a mounting bracket to support the board member therefrom the mounting bracket having a supporting flange removably engaging a top portion of the one horizontal beam, and said outer surface is selected ram a surface comprising a whiteboard, a blackboard, a chalk board, a metal surface for the attachment of magnets, a tack board and a cork board.

2. An arrangement as claimed in claim 1 wherein the flange of the board member is removably coupled to the bracket.

3. An arrangement as claimed in claim 2 including a plurality of said mounting brackets disposed spaced from each other along the length of the at least one beam proximate the top of the cladding panel.

4. A mounting arrangement as claimed in claim 2 wherein the bracket carries, outwardly of the at least one beam proximate the top of the cladding panel, said generally horizontally extending support flange having an opening therethrough, the flange of the board member include a generally downwardly extending tab extending through said aperture.

5. An arrangement as claimed in claim 2 wherein said generally horizontally extending support flange of said bracket is a generally planar flange outward of said at least one beam proximate the top of the cladding panel and adapted to receive and support the flange of the board member substantially co-planar thereon.

6. An arrangement as claimed in claim 1 wherein the flange of the board member is removably coupled to the bracket outwardly of the beam.

7. An arrangement as claimed in claim 6 wherein the flange is removably coupled to the bracket inwardly of the outer surface of the cladding panel.

8. A mounting arrangement as claimed in claim 1 wherein in addition to the beam proximate the top edge of the cladding panel, the framework includes a remote beam parallel thereto at the same height thereas but spaced inwardly therefrom away from the cladding panel, the bracket member engages the top portion of the beam proximate the cladding panel and a bottom portion of the remote beam.

9. An arrangement as claimed in claim 1 wherein the horizontal beams include a first set of beams on one side of the post and a second set of beams on the other side of the post such that the beams are provided as pairs of beams at the same height on opposite sides of the post;

the flange of the board member is removably coupled to the at least one beam proximate the top of the cladding panel via said mounting bracket which engages both the at least one beam proximate the top of the cladding panel and a beam on the other side of the post forming a pair therewith.

10. A mounting arrangement as claimed in claim 1 wherein the board member having a bottom edge, a tray member mounted on the partition proximate the bottom edge of the board member and extending outwardly of the board member.

11. An arrangement as claimed in claim 10 wherein a bottom edge of each cladding panel is proximate one horizontal beam and access to the horizontal beam is provided via an opening adjacent the bottom edge of the cladding panel along the length of the panel, the tray member including a flange extending inwardly under the bottom edge of the at least one cladding panel via the opening adjacent the bottom edge of the cladding panel and coupling to the at least one beam member proximate the bottom edge of the cladding panel to support the tray member therefrom.

12. An arrangement as claimed in claim 10 wherein the board member substantially vertically spans the cladding panel with the bottom edge of the board member disposed proximate the tray member.

13. An arrangement as claimed in claim 1 wherein said board member consists of a tin sheet of metal and the outer surface is selected from a surface comprising a whiteboard, a blackboard, a chalk board, and a metal surface forte attachment of magnets.

14. An arrangement as claimed in claim 1 wherein the flange of the board member is removably coupled to the support flange of the bracket via hook and loop touch fasteners.

15. An arrangement as claimed in claim 1 wherein the flange of the board member is removably coupled to the support flange of the bracket against movement other than movement of the board member upwardly relative the bracket.

16. An arrangement as claimed in claim 1 wherein the bracket has a generally S-shape in cross section with one end of the bracket to engage a top portion and a lateral surface of the at least one beam proximate the top of the cladding panel facing the cladding panel and with the other end of the bracket to engage with a bottom portion and a side pardon of the remote beam directed away from the cladding panel.

17. An arrangement as claimed in claim 1 wherein each cladding panel extends between vertically spaced horizontal beams.

18. A mounting arrangement for a display board comprising:

an upright partition having a supporting framework formed of horizontal beams and vertical posts with the beams spaced vertically from each other, a plurality of cladding panels mounted to the framework to cover the framework, each cladding panel having an outer surface spanning between a top and a bottom thereof, each cladding panel disposed outwardly of the horizontal beams with the top of each cladding panel proximate one horizontal beam and access to said one horizontal beam being provided via an opening adjacent the top of the cladding panel along the length of the cladding panel;

a display board member comprising a thin planar display panel having an outer surface and an inner surface, the display panel removably overlying at least one cladding panel with the inner surface of the display panel in opposed relation to the outer surface of the cladding panel, the display board member having at a top edge of the display panel a flange extending inwardly over the top of the at least one cladding panel through the opening and being coupled to the beam proximate the top of the at least one cladding panel to support the board member therefrom, the horizontal beams include a first set of beams on one side of the post and a second set of beams on the other side of the post such that the beams are provided as pairs of beams at the same height on opposite sides of the post;

the flange of the board member is removably coupled to the at least one beam proximate the top of the cladding panel via a mounting bracket which removably engages both the at least one beam proximate the top of the cladding panel and a beam on the other side of the post forming a pair therewith, the bracket has a generally S-shape in cross section with one end of the bracket engaging a top portion and a lateral surface of the at least one beam proximate the top of the cladding panel facing the cladding panel and with the other end of the bracket engaging with a bottom portion and a side portion of the remote beam directed away from the cladding panel.

19. An arrangement claimed in claim 18 wherein said board member consists of a Shin sheet of metal and the outer surface is selected from a surface comprising a whiteboard, a blackboard, a chalk board, and a metal surface for the attachment of magnets.

* * * * *